United States Patent [19]

Shaffer et al.

[11] Patent Number: 4,614,494

[45] Date of Patent: Sep. 30, 1986

[54] PRIMER INSULATING BASE

[75] Inventors: John W. Shaffer, Williamsport; Ronald E. Sindlinger, Muncy, both of Pa.

[73] Assignee: GTE Products Corporation, Stamford, Conn.

[21] Appl. No.: 807,421

[22] Filed: Dec. 10, 1985

[51] Int. Cl.[4] ..... F21K 5/00

[52] U.S. Cl. ..... 431/362

[58] Field of Search ..... 431/362

[56] References Cited

U.S. PATENT DOCUMENTS

| | | | |
|---|---|---|---|
| 3,602,619 | 8/1971 | Van der Tas . | |
| 3,627,459 | 12/1971 | Van der Tas . | |
| 3,685,947 | 8/1972 | Meulemans et al. . | |
| 3,823,994 | 7/1974 | De Graaf et al. | 316/26 |
| 3,884,615 | 5/1975 | Sobieski . | |
| 3,930,784 | 1/1976 | Anderson . | |
| 3,969,067 | 7/1976 | Schupp . | |
| 4,059,389 | 11/1977 | Armstrong et al. . | |
| 4,190,413 | 2/1980 | Shaffer et al. | 431/362 |
| 4,229,161 | 10/1980 | Bouchard et al. | 431/362 |
| 4,249,887 | 2/1981 | De Caro | 431/365 |
| 4,302,182 | 11/1981 | Shaffer | 431/362 |
| 4,369,028 | 1/1983 | Bricker et al. | 431/362 |
| 4,388,065 | 6/1983 | Martens | 431/362 |

*Primary Examiner*—Carroll B. Dority, Jr.
*Attorney, Agent, or Firm*—Martha A. Finnegan

[57] ABSTRACT

A high-voltage photoflash lamp is provided wherein the primer material is electrically insulated from the metallic shreds therein by an adherent layer of hollow electrically insulating beads. The layer of hollow beads is contiguous to the surface of the primer material within the lamp envelope.

11 Claims, 1 Drawing Figure

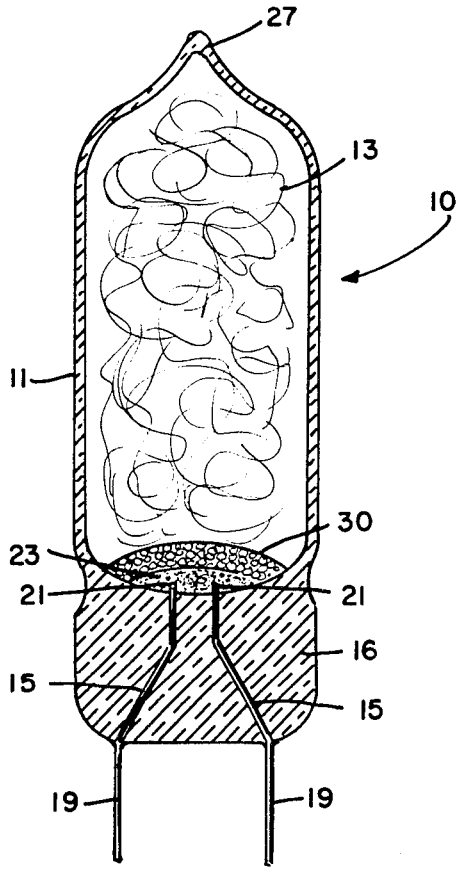
27
13
10
11
30
23
21
21
16
15
15
19
19

PRIMER INSULATING BASE

BACKGROUND OF THE INVENTION

The present invention relates to photoflash lamps and more particularly to high-voltage photoflash lamps.

A high-voltage flash lamp typically includes a glass envelope with a combustion-supporting gas and a quantity of filamentary, combustible material therein. A pair of electrically conductive lead wires is usually sealed in one end of the envelope and extend within the envelope. Medial portions of the extending ends of the lamp's conducting wires are located within a glass or ceramic bead. Primer material serves to bridge the portions of the ends which project through the bead. Flashing is accomplished by a firing pulse approaching a few thousand volts which is provided by a piezoelectric element. In another type of high-voltage lamp, the primer is located within an indentation in the bottom of the lamp and the conductive wires extend therein.

Understandably, it is highly desirous to prevent shred interference with the lamp's ignition. Shred interference can occur primarily in one of two ways: either by the shreds contacting and shorting the exposed portions of the lead wires within the envelope or by the shreds contacting and lying across the primer material surface.

In either case, the ignition voltage characteristics are altered, which in some instances can even prevent the lamp from firing. Shred interference can also reduce the firing voltage to the point that ignition is possible electrostatically. In situations wherein the lamp is used in circuitry containing several other lamps (e.g., sequential or random flash embodiments), an altered ignition voltage substantially reduces the lamp's compatibility with the desired circuit.

Various techniques for preventing shred interference with a lamp's ignition are illustrated. For example, in U.S. Pat. Nos. 3,884,615 and 3,685,947 a hollow glass bead is supported by the inner ends of the lead wires and primer is put into the cavity of the bead to electrically connect the two lead wires. This construction is bulky and does not permit miniaturization of the flash lamp. In addition, the beads are costly, and their mass, which is relatively isolated from the bulb, interferes with rapid cool down and liquification of oxygen, thereby limiting machine speeds.

In U.S. Pat. Nos. 3,823,994 and 3,627,459, the inner ends of the lead wires are exposed inside a small length of glass tubing which is sealed into the press. A quantity of primer within the tube connects the two lead wires electrically. This construction is costly in that it requires small pieces of fabricated glass tubing.

U.S. Pat. No. 4,229,161 teaches the use of a device, such as a disc of mica, to isolate electrically the shreds in the lamp from the primer. The beaded construction is also shown. Both the bead and the mica disc add considerably to the cost of the lamp and to the difficulty of cooling the lamp and thereby pressuring the lamp with oxygen.

It would be desirable to have a high-voltage photoflash lamp with improved reliability which reduces or eliminates shredd interference with lamp ignition without complicated and costly construction and without impeding rapid cool down.

SUMMARY OF THE INVENTION

In accordance with the present invention there is provided a high-voltage photoflash lamp comprising an hermetically-sealed light-transmitting envelope including a combustion-supporting atmosphere therein; a quantity of filamentary combustible material located within said envelope; ignition means for igniting said combustible material, said ignition means including a pair of electrical conductors sealed within said envelope and projecting therefrom, each of said conductors including an end portion having access to the interior of said envelope, a mass of primer material located within said envelope in electrical contact with said end portions of said electrical conductors; and a layer of hollow electrically insulating beads located between said primer material and said combustible material, the layer of the hollow beads being contiguous to the surface of said primer material.

BRIEF DESCRIPTION OF THE DRAWING

In the FIGURE there is shown a high-voltage photoflash lamp in accordance with the present invention.

For a better understanding of the present invention together with other and further objects, advantages, and capabilities thereof, reference is made to the following disclosure and appended claims in connection with the above-described drawing.

DETAILED DESCRIPTION OF THE INVENTION

With particular attention to the FIGURE, there is shown a photoflash lamp 10 which comprises an hermetically-sealed, light-transmitting envelope 11 having a combustion-supporting atmosphere and a quantity of combustible filamentary material 13 therein. Envelope 11 is manufactured from a tubular glass (e.g., lime glass) member having opposing ends. A pair of spaced-apart electrical conductors 15 are press-sealed within one end (16) of the tubular glass member such that portions 19 of these conductors project externally therefrom. Conductors 15 also include end portions 21 which have access to the interior of the envelope 11 such that a mass of primer material 23 may be placed in electrical contact therewith. Conductors 15 and primer 23 comprise the means for igniting combustible material 13 when an electrical pulse is applied thereto. Conductors 15 are buried in the primer 23, rather than having one conductor extend into the combustible material 13.

The pulse is preferably supplied by a piezoelectric element (not shown) located externally of lamp 10. Application thereof across conductors 15 results in intense deflagration of primer 23, which in turn ignites the main charge of the lamp, i.e., combustible material 13.

As stated, envelope 11 is glass. The preferred primer material 23 is a composition comprising zirconium, potassium perchlorate, and polyvinylpyrrolidone. One method of applying primer 23 is by the conventional dip process followed by a drying step (e.g., 100° C. for 15 minutes). Conductors 15 are preferably 0.016 inch (0.041 cm) diameter wires comprising a nickel-iron alloy.

The points at which the two wires emerge from the envelope are preferably located about 0.150 inch (0.381 cm) apart. The preferred combustible material 13 is shredded zirconium or hafnium, while the preferred supporting atmosphere is oxygen. Typically, the oxygen is established at a pressure of several atmospheres.

To prevent shreds 13 from engaging the external surface of conductive primer 23, an adherent layer 30 of hollow beads fabricated from electrically insulating material is located within envelope 11 between primer material 23 and combustible material 13. The layer 30 of hollow beads is contiguous to the surface of the primer material 23. The layer of hollow beads substantially completely covers the surface of the primer material in the lamp. The hollow beads used to form layer 30 are of a spherical configuration and have smooth non-permeable surfaces. The hollow beads are fabricated from electrically insulating materials such as glass quartz, glass silicates, or ceramic.

The beads used to form layer 30 have an average diameter from about 30 microns to about 300 microns. Use of hollow beads permits formation of a layer wherein the beads sit on top of the primer surface without sinking down into the primer. That is, the beads are in approximate tangential contact with the primer surface. In the configuration of the present invention, i.e., where the beads sit or "float" on top of the primer surface, the beads do not interfere with the electrical breakdown voltage of the lamp. When the beads sink into or are located in the primer, the electrical path is lengthened. Such elongated electrical path promotes very high voltage breakdown which is extremely undesirable in a high-voltage photoflash lamp. High voltage breakdown causes lamp failures because the voltage needed to flash the lamp may exceed that provided by the camera. To prevent sinkdown, the individual hollow beads should have densities less than about 0.7 $g/cm^3$, and preferably from about 0.4 to about 0.7 $g/cm^3$.

Preferably, layer 30 is formed by adding the hollow beads to the lamp while the primer is in liquid condition, i.e., before evaporation of the diluent contained in the primer after the primer is provided in the envelope. A preferred technique for positioning the hollow beads in the tubular glass member during lamp fabrication is to air blow the hollow beads into the glass member. Because the hollow beads can be air blown into the lamp, ease of construction is greatly enhanced.

After the diluent has fully evaporated, those beads which do not adhere to the surface of the primer are removed. Removal of the non-adhering beads can be accomplished, for example, by tipping the tubular glass member and pouring the loose hollow beads out of the open end of the tubular glass member. The layer of hollow beads has a thickness from about 500 to about 1000 microns. After the hollow bead layer is provided in the tubular glass member, the combustible material is positioned in the lamp, and the opposing end 27 of the glass tubing is sealed to define the ultimate configuration of the envelope 11. The preferred method for effecting this seal involves a tipping operation well known in the photoflash lamp art.

EXAMPLE

A high-voltage flash lamp having a light-transmitting envelope with a 5.2 mm inside diameter and a volume of about 0.30 $cm^3$ was fabricated.

A pair of lead-in wires was sealed into a first end of an elongated light-transmitting tube such that one end of each lead-in wire extended to the exterior of the sealed end and the opposing end of each lead wire extended into the interior of the glass tube. The ends of the lead-in wires extending into the interior of the tubular glass member extend into the envelope a distance approximately equal to the diameter of a single lead-in wire, i.e., 0.016 inch (0.041 cm). The lead-in wires (51% by weight of Ni, and 49% by weight of Fe) had a diameter of about 0.41 mm. A quantity of about 4 mg primer material was positioned within the tube through the second open end thereof so as to form a convex surface. The primer used consisted of about 90% by weight zirconium, about 8% by weight potassium perchlorate, and about 2% by weight polyvinylpyrrolidone.

An adherent layer of hollow electrically insulating beads, the layer having a thickness of about 0.81 mm, was provided in the lamp by blowing the beads onto the primer surface in an inverted bottle assembly. The beads used were hollow glass beads having a diameter of about 150 microns and had an average density of about 0.65 $g/cm^3$.

A quantity of 10 mg zirconium shreds was positioned in the glass tube and the oxygen gas was introduced therein after which the second open end was sealed to form the envelope of the finished lamp.

Thus, there has been shown and described a photoflash lamp which represents a substantial improvement over lamps of the prior art. A method of making this lamp has also been described.

While there have been shown and described what are at present considered the preferred embodiments of the invention, it will be obvious to those skilled in the art that various changes and modifications may be made therein without departing from the scope of the invention as defined by the appended claims.

What is claimed is:

1. A high-voltage photoflash lamp comprising:

an hermetically-sealed light-transmitting envelope including a combustion-supporting atmosphere therein;

a quantity of filamentary combustible material located within said envelope;

ignition means for igniting said combustible material, said ignition means including a pair of electrical conductors sealed within said envelope and projecting therefrom, each of said conductors including an end portion having access to the interior of said envelope;

a mass of primer material located within said envelope in electrical contact with said end portions of said electrical conductors, said end portions of said electrical conductors being buried in said primer material; and a layer of hollow electrically insulating beads located between said primer material and said combustible material, the layer of hollow beads being contiguous to the surface of said primer material.

2. A high-voltage photoflash lamp in accordance with claim 1 wherein the hollow electrically insulating beads are glass.

3. A high-voltage photoflash lamp in accordance with claim 1 wherein the hollow electrically insulating beads are ceramic.

4. A high-voltage photoflash lamp in accordance with claim 1 wherein the hollow beads have an average diameter from about 30 microns to about 300 microns.

5. A high-voltage photoflash lamp in accordance with claim 1 wherein the layer of hollow beads has a thickness from about 500 to about 1000 microns.

6. A high-voltage photoflash lamp in accordance with claim 1 wherein the hollow beads have densities from about 0.4 to about 0.7 $g/cm^3$.

7. A high-voltage photoflash lamp comprising:

an hermetically-sealed light-transmitting envelope including a combustion-supporting atmosphere therein;

a quantity of filamentary combustible material consisting essentially of zirconium shreds located within said envelope;

ignition means for igniting said combustible material, said ignition means including a pair of electrical conductors sealed within said envelope and projecting therefrom, each of said conductors including an end portion having access to the interior of said envelope;

a mass of primer material comprising zirconium, potassium perchlorate, and polyvinylpyrrolidone located within said envelope in electrical contact with said end portions of said electrical conductors; and a layer of hollow glass beads located between said primer material and said combustible material, the layer of beads being contiguous to the surface of said primer material.

8. A high-voltage photoflash lamp in accordance with claim 7 wherein the surface of the primer material within the lamp envelope has a convex configuration.

9. A high-voltage photoflash lamp in accordance with claim 7 wherein the hollow glass beads have a diameter of about 150 microns.

10. A high-voltage photoflash lamp in accordance with claim 9 wherein the hollow beads have a density of about 0.65 g/cm$^3$.

11. A high-voltage photoflash lamp in accordance with claim 10 wherein the layer of hollow beads has a thickness of about 0.81 mm.

* * * * *